US005320295A

United States Patent [19]

Jääskeläinen et al.

[11] Patent Number: 5,320,295

[45] Date of Patent: Jun. 14, 1994

[54] DEVICE FOR A DISPLACING CARRIAGE FOR DISPLACING A CYLINDRICAL BODY INTO A WINDING MACHINE

[75] Inventors: Vesa Jääskeläinen, Bro; Gustaf Linderoth, Enköping, both of Sweden

[73] Assignee: Nokia-Maillefer Holding S.A., Ecublens, Switzerland

[21] Appl. No.: 932,931

[22] Filed: Aug. 21, 1992

[30] Foreign Application Priority Data

Sep. 3, 1991 [SE] Sweden ..... 914145

[51] Int. Cl.[5] ..... B65H 75/00; B60P 3/035

[52] U.S. Cl. ..... 242/54 R; 242/58.6; 242/68.4; 414/458; 414/911; 280/43.2; 280/79.6

[58] Field of Search ..... 242/54 R, 58.6, 68.4, 242/79; 414/426, 427, 429, 458, 495, 910, 911; 280/43.2, 79.4, 79.6, 638

[56] References Cited

U.S. PATENT DOCUMENTS

| | | | |
|---|---|---|---|
| 2,527,667 | 10/1950 | Wood | 242/79 |
| 2,706,056 | 4/1955 | Talley et al. | 414/458 |
| 3,325,118 | 6/1967 | Hall | 242/58.6 |
| 3,941,324 | 3/1976 | Green | 242/54 R |
| 4,148,406 | 4/1979 | Kutzschebauch | 242/58.6 X |
| 4,183,710 | 1/1980 | Burdick | 414/458 X |
| 4,655,670 | 4/1987 | Högberg et al. | 414/426 X |
| 4,743,157 | 5/1988 | Takatsuki | 414/429 X |
| 4,754,937 | 7/1988 | Hoddinott et al. | 242/54 R X |
| 4,781,335 | 11/1988 | Compagnon | 242/54 R |
| 4,886,284 | 12/1989 | Martinez, Jr. | 414/429 X |
| 5,052,877 | 10/1991 | Jääskeläinen et al | 414/458 |
| 5,123,602 | 6/1992 | Skalleberg et al. | 242/54 R |
| 5,242,127 | 9/1993 | Jääskeläinen | 242/54 R |

FOREIGN PATENT DOCUMENTS

| | | | |
|---|---|---|---|
| 3406532 | 9/1984 | Fed. Rep. of Germany | 242/58.6 |

*Primary Examiner*—Daniel P. Stodola
*Assistant Examiner*—John P. Darling
*Attorney, Agent, or Firm*—Nixon & Vanderhye

[57] ABSTRACT

A carriage for displacing a cylindrical body into a winding machine, comprising two support elements (9) defining therebetween a space for receiving the body (2) and being adjustable with respect to each other in a transverse direction of the elements; fixed support plates (10) attached to the support elements for supporting the body; and a machinery for lifting and lowering the support plates. To measure the size of the body and to be able to adjust the winding machine in advance, the carriage comprises sensors (15, 18) for measuring the width and diameter of the body while the body is supported by the support plates; and a transmitter (24) for transmitting the measuring results to the winding machine.

16 Claims, 2 Drawing Sheets

Figure 1:
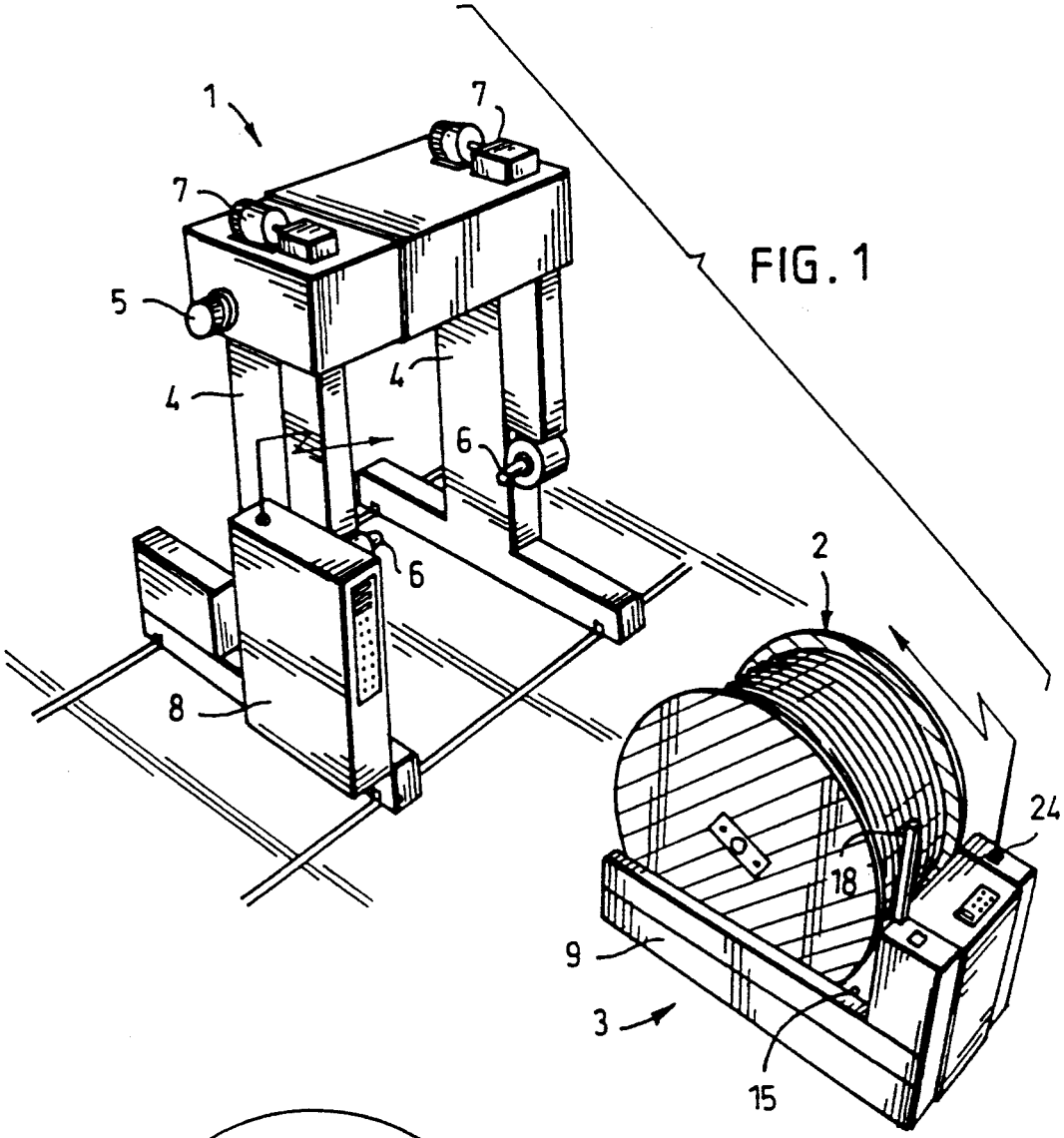

FIG. 2
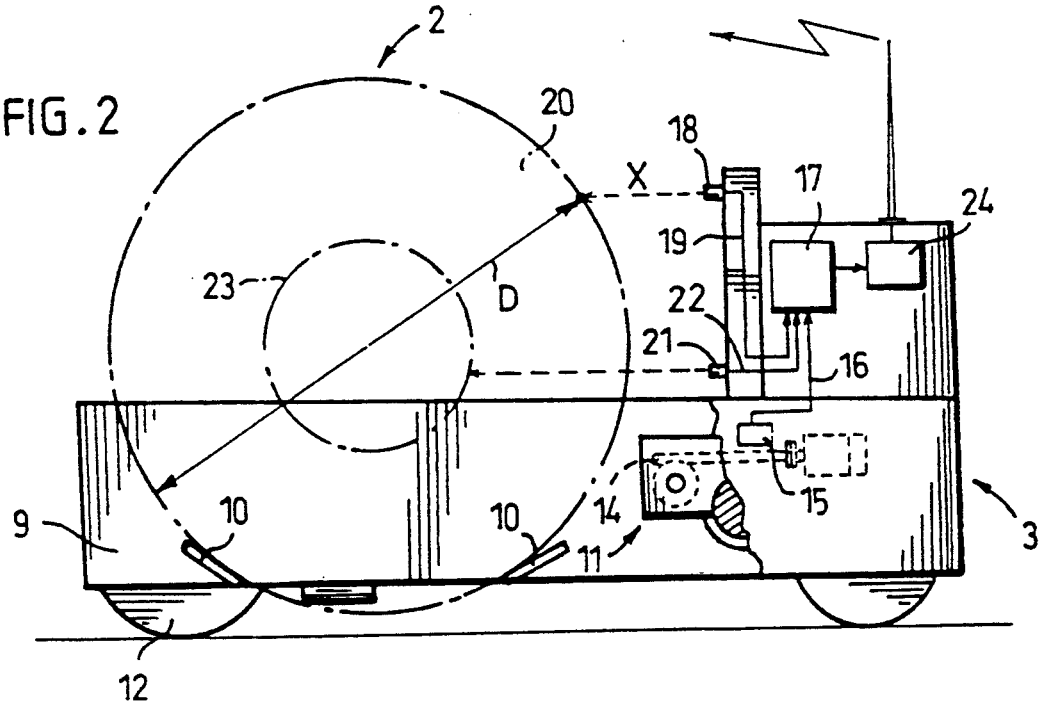
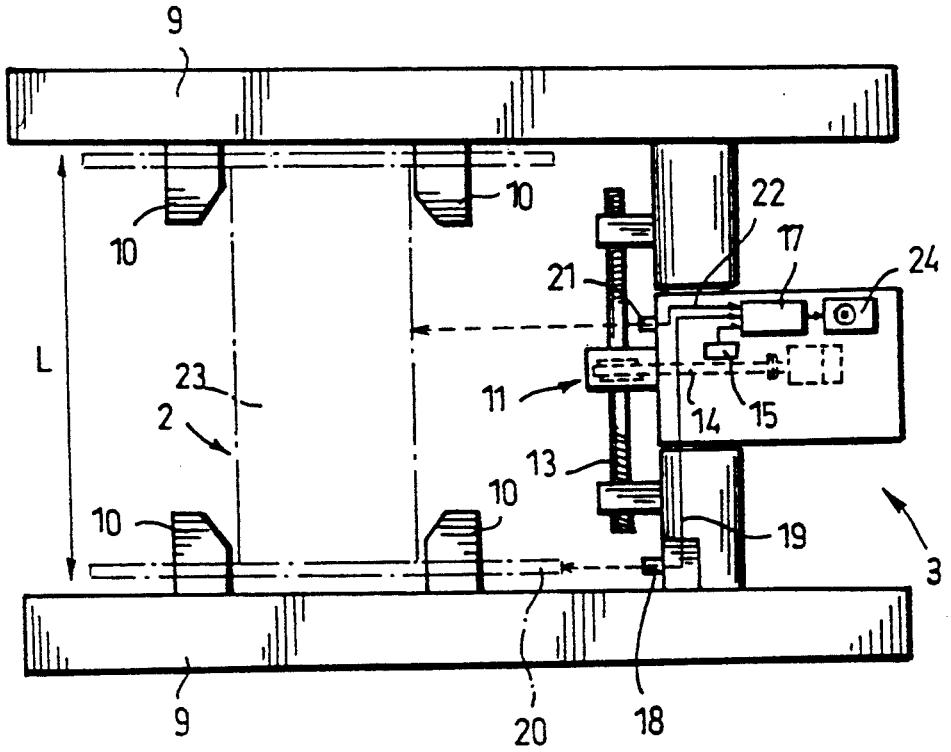
FIG. 3

DEVICE FOR A DISPLACING CARRIAGE FOR DISPLACING A CYLINDRICAL BODY INTO A WINDING MACHINE

This invention relates to a device for a displacing device for displacing a cylindrical body, especially a cable reel, along an underlying surface to be supported by gripping means in a winding machine, the carriage comprising two parallel wheeled support elements defining therebetween a space for receiving the body, the support elements being adjustable by means of an adjusting machinery towards and away from each other in a transverse direction of the support elements;

support means provided in the support elements for supporting the body to be displaced; and means for lifting and lowering the support means for raising the body to be displaced from the underlying surface and for lowering the body to the surface, respectively.

Even though the invention will be described below mainly in connection with cable reels, the expression "cylindrical body" is also intended to refer to other cylindrical objects, such as paper rolls, rope reels, drums, and the like.

In the production of an electric cable, the finished cable is wound on a cable reel in a special winding machine. One example of such a winding machine is disclosed in Finnish Patent Specification 83756, Nokia-Maillefer Holding S.A. The winding machine comprises two massive pillars horizontally adjustable with respect to each other and interconnected by means of an upper beam. The pillars support vertically adjustable gripping pins which grip into central holes in the flanges of the reel. The purpose is to raise the cable reel by means of the gripping pins so that the reel can be rotated about its central axis. This kind of winding machine may be highly automated to perform automatically all winding operations, the lifting and lowering movements of the gripping pins, and the horizontal adjustments of the pins towards and away from each other for reels of different sizes.

It is known to displace reels from a storage of reels into a winding machine by means of special displacing carriages. One example of such a displacing carriage is disclosed in Finnish Patent Specification 82667, Nokia-Maillefer Holding S.A. The displacing carriage comprises two wheeled support elements provided with support means for lifting a reel supported between the support elements from the underlying surface for transporting the reel. This kind of displacing carriage may be highly automated to perform automatically all displacing movements as well as the lifting and lowering movements of the reels when displacing reels of different sizes.

To speed up the winding stages, it is important that the size of a specific reel to be wound, i.e. its width and diameter are known in advance so that the gripping pins of the winding machine can be pre-adjusted at a mutual distance and at a height corresponding to the size of the reel when the displacing carriage is ready to deliver the next reel to be wound in the winding machine. The automatic co-operation between the winding machine and the displacing carriage is effective when the displacing carriage fetches reels from a computer-controlled storage of reels, as the size of reels at each particular point of the storage is thereby known in advance. Difficulties occur when the displacing carriage fetches reels e.g. from a group of reels supplied by a customer or when the reels have been changed manually in the storage so that they may easily get mixed up by accident. To avoid such a risk of error, an operator usually has to be present even in an automatic winding operation to control the displacement of reels and to correct the adjusting of the winding machine, if required.

The object of the present invention is to provide a device for the displacing carriage which avoids the above-mentioned disadvantage and by means of which the displacing carriage itself is able to identify the size of the cylindrical body displaced by it into the winding machine, and provides corresponding information for the adjusting machinery of the gripping pins of the winding machine. This object is achieved by means of a device according to the invention, which is characterized in that the carriage comprises means for measuring the axial width and diameter of the cylindrical body to be displaced while the body is supported by the support means; and means for transmitting the measuring results to the winding machine for adjusting its gripping means.

The invention enables the width and diameter of the cylindrical body to be determined by simple means while the body is positioned in the displacing carriage, so that reliable information is obtained on the size of the body to be displaced. As the measuring results are applied to the winding machine, it is ensured that the gripping pins of the winding machine will be in a receiving position corresponding to the body to be wound next. In this way, the risk of damage caused by a wrong position of the gripping pins is avoided, the winding stages are speeded up, and less operating staff is needed.

Figure 4:
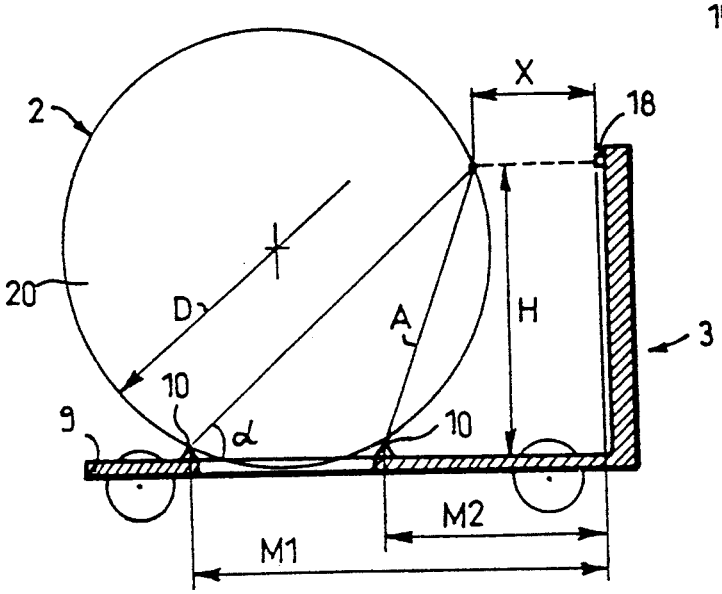

In the following the invention will be described in more detail with reference to the attached drawings, in which FIG. 1 is a perspective view of the cooperation of a winding machine with a displacing carriage;

FIGS. 2 and 3 are a more detailed side and top view, respectively, of a displacing carriage provided with a device according to the invention; and FIG. 4 illustrates the operating principle of the diameter measuring means of the device.

FIG. 1 of the drawings shows a winding machine 1 for winding a cable onto a reel 2 or for unwinding it from the reel, and a displacing carriage 3 for transporting the cable reel into and from the winding machine. In the embodiment described herein, the winding machine is of the structure described in Finnish Patent Specification 83756, and the displacing carriage is of the structure described in Finnish Patent Specification 82667, and therefore only their principal features will be described in the following.

The winding machine comprises two pillars 4 which are movable horizontally with respect to each other by means of an adjusting machinery 5. The pillars are provided with gripping pins 6 which are movable vertically by means of an adjusting machinery 7. The winding machine is provided with a control system 8 by means of which the operation of the adjusting machineries as well as all the winding operations can be controlled manually and automatically.

The displacing carriage comprises two parallel support elements 9 which define therebetween a space for the cable reel. Two mutually spaced fixed lifting plates 10 are attached to both support elements. The support elements are displaceable transversely towards each other and away from each other by means of an adjusting machinery 11. The support elements are provided with wheels 12 which can be lifted and lowered in a vertical plane for lifting the support elements into a transport position or lowering them into a loading or unloading position.

In the embodiment described the adjusting machinery 11 of the support elements comprises an adjusting rod 13 which is engaged with one support element by means of a left-handed screw and with the other element by means of a right-handed screw. The adjusting rod can be rotated by a drive shaft 14 to which an encoder 15 is connected for sending a digital signal 16 proportional to the number of rotations of the drive shaft to a calculating device 17. As the rotation of the drive shaft displaces the support elements closer to and away from each other, the number of rotations of the drive shaft provides information on the distance between the lifting plates of the support elements, that is, information on the width L of the reel supported by the lifting plates.

The displacing carriage is also provided with a sensor 18 mounted at a predetermined height in a vertical plane extending through the lifting plates 10 of one support element. The sensor operates on the triangle measuring principle, as will be described below, and generates a signal 19 which is sent to the calculating device 17. The sensor is positioned in close vicinity of a flange 20 of the reel supported by the displacing carriage, and so it measures a distance X to the periphery of the flange. On the basis of this distance, information is obtained on the diameter D of the reel.

The displacing carriage is further provided with a sensor 21 mounted midway between the support elements and directed towards a drum 23 of the reel. The sensor measures the distance to the drum and generates a signal 22 which is sent to the calculating device 17. This distance indicates whether the reel is empty or full.

FIG. 4 illustrates the way of measuring of the sensor 18.

The position of the lifting plates 10 of the support element is fixed, and the distance from a vertical line passing through the sensor is M1 and M2, respectively. The sensor is positioned at a height H from a horizontal plane passing through the lifting plates. The reel is placed on the fixed lifting plates when the support elements are lifted into the transport position. The periphery of the flange of the reel is thereby positioned at a horizontal distance X from the sensor. When the sensor measures the distance X, the diameter D of the flange of the reel will be obtained as follows:

$$A = \sqrt{H^2 + (M2 - X)^2}$$

$$\alpha = \arctan \frac{H}{M1 - X}$$

$$D = \frac{A}{\sin\alpha}$$

The calculating device 17 contains required calculators and programming means and a transmitter 24 for transmitting the measuring results to the control system 8 of the winding machine. The measuring results obtained by the sensors 15 and 21 are also transmitted from the calculating device by means of the transmitter to the control system of the winding machine, which sends the required impulses to the adjusting machineries of the pillars and the gripping pins for displacing the gripping pins to a receiving position corresponding to the size of the reel. To measure the diameters of the flanges of the reels, only the sensor 18 is needed.

The drawings and the description related thereto are only intended to illustrate the idea of the invention. In its details, the device according to the invention may vary within the scope of the claims. In place of the pulse sensor 15, the measuring of the width of the reel may be carried out by means of a rotary potentiometer or a linear potentiometer, which generate an analog signal. The measuring of the width may also be carried out by using an ultrasonic, infrared or optical sensor positioned at a suitable point in those portions of the displacing carriage that move towards each other. For the distance measurement, the sensor 18 may be a photocell, ultrasound, laser, or the like. The measuring results may be transmitted by a radio, an infrared transmitter or an inductive loop provided in the floor. The distance between the support points 10 of the reel supported by the lifting plates may vary slightly with different reel sizes but this can be compensated for by calibrating the calculating means of the sensor 18 for the different reel size ranges.

We claim:

1. Apparatus for displacing a cylindrical body along an underlying surface into a supported position by gripping means in an ancillary machine, the apparatus comprising:

two elongated parallel wheeled support elements defining therebetween a space for receiving the body;

adjusting machinery for adjusting at least one of said support elements toward and away from another of said support elements in a transverse direction of the support element;

supports carried by said support elements for supporting the body to be displaced;

means for lifting and lowering the supports for raising the body to be displaced from the underlying surface and for lowering the body to the surface, respectively;

means for measuring the axial width and diameter of the cylindrical body to be displaced while the body is supported by said supports and providing signals representative of the measured width and diameter of the body; and means for transmitting the signals representative of the measured width and diameter to the machine for adjusting the gripping means thereof.

2. Apparatus according to claim 1 wherein said width measuring means comprises a sensor for sensing the operation of said adjusting machinery adjusting the support elements, said sensor being disposed to sense the adjusted distance between the supports and being connected to said transmitting means.

3. Apparatus according to claim 1 wherein said supports include first and second supports on each support element and spaced from one another in planes parallel to the diametrical plane of the body, the diameter measuring means including a sensor for determining the horizontal distance of the body from the sensor and a means coupled to said sensor for determining the diameter of the cylindrical body supported on said supports in accordance with the following formulae:

$$A = \sqrt{H^2 + (M2 - X)^2}$$

$$\alpha = \arctan \frac{H}{M1 - X}$$

$$D = \frac{A}{\sin\alpha}$$

wherein X is the horizontal distance from the sensor to its intersection with the nearest circumference of the body; H is the height of the sensor from a horizontal plane passing through said support elements and forming substantially a tangent to said body in said horizontal plane; M1 and M2 are the horizontal distances to the first and second supports from a vertical line through said sensor; $\alpha$ is the angle between said horizontal plane at the distance M1 and a straight line connecting the first support and said intersection; and D is the diameter of the body.

4. Apparatus according to claim 1 wherein the supports for the body comprise two fixed lifting plates carried by each of said support elements, the lifting plates projecting into the space between said support elements and being positioned in pairs at a fixed distance from each other in the longitudinal direction of the support elements, said diameter measuring means comprising a distance sensor mounted in a longitudinal vertical plane extending through the lifting plates carried by one of the support elements, the distance sensor being disposed to measure the distance from a reference point in said plane at a known elevation above said support plates to a peripheral edge of the cylindrical body raised by the lifting plates; and a calculating device for calculating the diameter of the body on the basis of said distance measurement and known horizontal distances of said support plates from a vertical line in said plane passing through said reference point and said know elevation.

5. Apparatus according to claim 4 wherein said displacing apparatus comprises a carriage having means for measuring the diameter of a central portion of the cylindrical body supported by the lifting plates.

6. Apparatus according to claim 5 wherein the means for measuring the diameter of the central portion comprises a distance meter carried by said carriage in the space between said support elements and providing a signal representative of the distance between the distance meter and the central portion of said body, said transmitting means including means for transmitting the signal representative of the distance between the distance meter and the central portion of the body.

7. Apparatus according to claim 1 wherein the means for transmitting the signals representative of the known width and diameter of the body comprise a radio transmitter.

8. Apparatus according to claim 1 wherein the means for transmitting the signals representative of the known width and diameter of the body comprise an infrared transmitter.

9. Apparatus according to claim 1 in combination with said cylindrical body, said cylindrical body comprising a cable reel having a pair of transversely spaced end plates and a reel portion therebetween, said supports being disposed for engagement by the peripheral surfaces of said end plates, said measuring means measuring the axial distance between the end plates and the diameter of the end plates.

10. Apparatus according to claim 9 wherein said width measuring means comprises a sensor for sensing the operation of said adjusting machinery adjusting the support elements, said sensor being disposed to sense the adjusted distance between the support means and being connected to said transmitting means.

11. Apparatus according to claim 9 wherein said supports include first and second supports on each support element and spaced from one another in planes parallel to the diametrical plane of the body, the diameter measuring means including a sensor for determining the horizontal distance of the body from the sensor and a means coupled to said sensor for determining the diameter of the cylindrical body supported on said supports in accordance with the following formulae:

$$A = \sqrt{H^2 + (M2 - X)^2}$$

$$\alpha = \arctan \frac{H}{M1 - X}$$

$$D = \frac{A}{\sin\alpha}$$

wherein X is the horizontal distance from the sensor to its intersection with the nearest circumference of the body; H is the height of the sensor from a horizontal plane passing through said support elements and forming substantially a tangent to said body in said horizontal plane; M1 and M2 are the horizontal distances to the first and second supports from a vertical line through said sensor; $\alpha$ is the angle between said horizontal plane at the distance M1 and a straight line connecting the first support and said intersection; and D is the diameter of the body.

12. Apparatus according to claim 9 wherein the supports for the body comprise two fixed lifting plates carried by each of support elements, the lifting plates projecting into the space between said support elements and being positioned in pairs at a fixed distance from each other in the longitudinal direction of the support elements, said diameter measuring means comprising a distance sensor mounted in a longitudinal vertical plane extending through the lifting plates carried by one of the support elements, the distance sensor being disposed to measure the distance from a reference point in said plane at a known elevation above said lifting plates to a peripheral edge of the cylindrical body raised by the lifting plates; and a calculating device for calculating the diameter of the body on the basis of said distance measurement and known horizontal distances of said support plates from a vertical line in said plane passing through said reference point and said known elevation.

13. Apparatus according to claim 9 wherein the means for transmitting the signals representative of the known width and diameter of the body comprise a radio transmitter.

14. Apparatus according to claim 9 wherein the means for transmitting the signals representative of the known width and diameter of the body comprise an infrared transmitter.

15. Apparatus according to claim 9 wherein said displacing apparatus comprises a carriage having means for measuring the diameter of a central portion of the cylindrical body supported by the lifting plates.

16. Apparatus according to claim 9 wherein the means for measuring the diameter of the central portion comprises a distance meter carried by said carriage in the space between said support elements and providing a signal representative of the distance between the distance meter and the central portion of said body, said transmitting means including means for transmitting the signal representative of the distance between the distance meter and the central portion of the body.

* * * * *

UNITED STATES PATENT AND TRADEMARK OFFICE

CERTIFICATE OF CORRECTION

PATENT NO. : 5,320,295

DATED : June 14, 1994

INVENTOR(S) : Vesa Jääskeläinen; Gustaf Linderoth

It is certified that error appears in the above-indentified patent and that said Letters Patent is hereby corrected as shown below:

On title page, item [56]: Foreign Application Priority Data should reflect Finland as the country of origin of the priority application.

Signed and Sealed this

Sixth Day of September, 1994

*Attest:*

Bruce Lehman

BRUCE LEHMAN

*Attesting Officer*

*Commissioner of Patents and Trademarks*